US008141474B2

(12) United States Patent
Dublin

(10) Patent No.: US 8,141,474 B2
(45) Date of Patent: Mar. 27, 2012

(54) CHARGING MECHANISM FOR GAS POWERED FIREARMS

(76) Inventor: Ethan A. Dublin, Cherryfield, ME (US)

( * ) Notice: Subject to any disclaimer, the term of this patent is extended or adjusted under 35 U.S.C. 154(b) by 308 days.

(21) Appl. No.: 12/540,443

(22) Filed: Aug. 13, 2009

(65) Prior Publication Data

US 2011/0036232 A1 Feb. 17, 2011

(51) Int. Cl.
*F41A 5/18* (2006.01)

(52) U.S. Cl. ..... 89/191.01; 89/1.4

(58) Field of Classification Search ..... 89/191.01, 89/191.02, 192, 1.4
See application file for complete search history.

(56) References Cited

U.S. PATENT DOCUMENTS

| | | | | |
|---|---|---|---|---|
| 6,311,603 | B1 | 11/2001 | Dunlap | |
| 7,261,029 | B1 | 8/2007 | Davis | |
| 7,874,240 | B2 * | 1/2011 | Akhavan | 89/179 |
| 2007/0006720 | A1 * | 1/2007 | Liao | 89/1.4 |

* cited by examiner

*Primary Examiner* — Stephen M Johnson
(74) *Attorney, Agent, or Firm* — Anthony D. Pellegrini

(57) ABSTRACT

An improved mechanism for charging a gas powered firearm, especially with regard to the Kalashnikov variants of rifles known as AK-47s, comprising a modified gas tube having a lateral aperture formed into its left side, a semi-cylindrical sleeve suitably adapted to fit within the modified gas tube over the shaft of the operating rod, and a modified charging handle suitably adapted to connect to the sleeve and to extend from the firearm through the lateral aperture, such that the firearm may be manually charged from the left side by drawing the charging handle rearward; and providing safety improvements and a method of retrofitting firearms.

15 Claims, 12 Drawing Sheets

CHARGING MECHANISM FOR GAS POWERED FIREARMS

FIELD OF THE INVENTION

The present invention relates generally to firearms, and specifically to an improved mechanism for charging a firearm, especially with regard to the Kalashnikov variants of rifles known as AK-47s. Implementation of the invention results in a safer method of operation of the firearm, easier function for a right handed individual, faster reloading, quicker cooling of hot areas, easier cleaning, and a more practical charging handle configuration. Moreover, the invention allows for the easy and inexpensive modification of existing configurations, requiring few new or extra parts. The present invention also contemplates a method of retrofitting firearms to utilize the improved mechanism for charging a firearm.

BACKGROUND

AK-47 rifles are so-called gas powered firearms, in which the discharge gases from a fired round of ammunition serve to automatically eject the spent cartridge casing from the just fired round and to chamber a new round for firing. The standard charging mechanism of an AK-47 is fairly straightforward. These firearms comprise a barrel in communication with a firing chamber, or breach, and a bolt used to provide access to the breach. The barrel comprises a port or similar aperture which permits some of the discharge gases created from the firing of a round of ammunition to escape the barrel through the port. The port is in communication with an adjacent chamber known as a gas block, which in turn is in communication with an adjacent, substantially cylindrical structure known as a gas tube. Contained within the gas tube is a piston known as an operating rod. The operating rod has a forward portion with an outside diameter substantially the same as the inside diameter of the gas tube. The rearward end of the operating rod is in connection with the bolt assembly. The operating rod is designed to move forward and rearward within the gas tube, with its rearward movement designed to simultaneously force the bolt assembly rearward, which in turn compresses a recoil spring mechanism. The recoil spring mechanism in turn forces the bolt assembly forward, returning it to its firing position, which in turn moves the operating rod forward within the gas tube.

A standard AK-47 must be charged in order to operate. Charging of the firearm comprises the loading and reloading of ammunition into the firing chamber and occurs during the rearward and forward movement of the bolt assembly described above. During operation, charging is done automatically by utilizing the discharge gases of a fired round of ammunition. When a round is fired, the cartridge casing remains at one end of the barrel and the gases formed by the explosion force the bullet to travel down the length of the barrel. As the bullet passes the barrel port, some of the discharge gases escape through the barrel port and pass through the gas block into the gas tube, where the gases impinge upon the forward portion of the operating rod, driving it rearward. This rearward travel of the operating rod moves the bolt rearward, opening the breach, ejecting the spent cartridge casing from the breach, and compressing the recoil spring mechanism in connection with the rear portion of the bolt. While the bolt is thus in its rearward position and the breach is opened, a new round may be loaded into the breach by action of a spring mechanism in an ammunition magazine. The bolt is returned to its forward position by the recoil spring mechanism, closing the breach and returning the operating rod to its forward position. This process may continue until all of the ammunition is used and the ammunition magazine and the firing chamber are both emptied.

The automatic loading cycle of each round of ammunition described above takes place upon the firing of the previous round. However, the initial charging of the firearm in which the first round is loaded into the firing chamber must be accomplished manually, as no discharge gases have yet been created to accomplish this task. Initial charging of a standard AK-47 is accomplished by manually drawing the bolt assembly rearward. This is done by manually grasping and drawing back a charging handle which is in connection with the bolt assembly and located on the right side of the firearm. Drawing the charging handle rearward results in the same loading of the round into the breach by the spring mechanism in the ammunition magazine as described above. Releasing the charging handle allows the recoil spring mechanism to return the bolt to its forward position, closing the breach, resulting in the firearm being loaded and ready for firing.

The current state of the art for initially charging an AK-47 is less than ideal. A standard AK-47 presents a training problem for the operator. One significant issue is the charging handle being on the right side of the firearm. A right handed operator will hold the pistol grip of the firearm in the right hand and support the barrel of the firearm with the left hand. The butt of the rifle is kept on the operator's right shoulder and the right hand remains on the pistol grip at all times, for safety, leaving the left hand to manually charge the firearm. In order to manually charge the firearm the left hand must be removed from the barrel and the operator then reaches over or under the firearm to grasp the charging handle with the left hand. The use of the left hand in the described manner usually results in the loss of sight picture and an unbalanced firearm because of the transition of the operator's hand over or under the firearm. When shooting the firearm the left hand supports the barrel of the firearm and keeps it steady. Upon removal of the left hand the barrel tends to dip downward and sight picture to the target is lost. Since the charging handle is located near the rear of the firearm on a standard AK-47, the requirement of the operator to reach back also jeopardizes the firearm balance, introducing lateral movement when charging the firearm. This method of charging also results in slower charging due to the amount of distance the left hand must travel.

Another deficiency of the charging mechanism of the standard AK-47 rifle is that the gas tube of the standard AK-47 rifle has a closed cylindrical configuration. It has no opening to allow for easy access to its interior for purposes of cleaning or allowing air flow to cool the firearm. The greatest amount of debris and fouling occurs within the gas block and the interior of the gas tube, since the discharge gases contain spent powder residue. This residue stays in the gas tube and tends to build up as round after round is fired. If it is not periodically removed the charging mechanism of the firearm will fail to operate properly, resulting in improper or even unsafe operation. In order to clean this residue the firearm must be disassembled so that a cleaning cloth can be inserted into the gas tube. This is a time consuming operation and requires frequent periods of inactivity of use of the firearm. Moreover, the closed configuration of the gas tube prevents easy visual inspection of the firing chamber; that is, one cannot visually inspect the chamber to determine whether cleaning is needed or even if a round is loaded therein without some degree of disassembly of the firearm. This presents a safety issue.

Another deficiency of the charging mechanism of the standard AK-47 rifle is that the bolt assembly has no bolt locking mechanism. That is, the bolt is always positioned forward pressing against the firing chamber as a result of the recoil spring mechanism, and there is no way to keep it away from the firing chamber unless the operator applies a constant force on the bolt assembly by drawing and holding back the charging handle. Upon the operator releasing the charging handle the bolt assembly returns to the forward position by the recoil spring mechanism.

The standard AK-47 rifle has a safety lever located on the right side of the firearm near the charging handle. When the safety lever is engaged the trigger is locked and cannot move. The safety lever is so positioned as to block the travel of the charging handle when the safety lever is in the locked position. This means that the charging handle cannot be fully drawn rearward to retract the bolt assembly in order to chamber a round when the trigger is locked and the safety lever is engaged. In order to charge the firearm the safety lever must be disengaged, resulting in the trigger not being locked during charging. This presents another potential safety issue.

The basic design of the AK-47 rifle described above also pertains to other popular gas powered firearms, such as the various Kalashnikov variants (AK-74, AK-101, AK-103, and others), the Samozaryadniy Karabin sistemi Simonova (SKS) rifle and its variants, and the Fusil Automatique Leger-Light Automatic Rifle (FN-FAL) and its variants, as well as other designs. In this respect, to the extent the deficiencies described above also apply to these other gas powered firearms, the remediation which is addressed by the present invention applies to these firearms as well.

There thus remains a need for an improved charging mechanism for a gas powered firearm that is easier to use for right handed operators, improves the safety profile of the firearm, is easier to clean, and is simple and cost effective to manufacture and to retrofit into existing firearms.

It is therefore an object of an aspect of the invention to provide an improved charging mechanism for a gas powered firearm which adds safety features to the firearm.

It is a further object of an aspect of the invention to provide an improved charging mechanism for a gas powered firearm which is easier to use for right handed operators.

It is yet a further object of an aspect of the invention to provide an improved charging mechanism for a gas powered firearm that is easy to clean and maintain.

It is yet a further object of an aspect of the invention to provide an improved charging mechanism for a gas powered firearm which is easy to manufacture.

It is yet a further object of an aspect of the invention to provide an improved charging mechanism for a gas powered firearm which is easy to retrofit to an existing firearm.

It is yet a further object of an aspect of the invention to provide an improved charging mechanism for a gas powered firearm which allows for faster loading and more accurate operation of the firearm.

It is yet a further object of an aspect of the invention to provide an improved charging mechanism for a gas powered firearm that improves the durability of the firearm by reducing harmful heat buildup.

It is yet a further object of an aspect of the invention to provide a method for retrofitting a gas powered firearm with an improved charging mechanism.

Other objects of this invention will be apparent to those skilled in the art from the description and claims which follow.

SUMMARY OF THE INVENTION

An aspect of the present invention discloses repositioning of the charging handle of a gas powered firearm to the left side of the firearm, further forward than the standard positioning of the charging handle. This accomplishes two purposes. First, by positioning the charging handle on the left side of the firearm, a right handed operator need not reach around over the top or underneath the firearm with the left hand to reach the charging handle. Rather, the charging handle is proximate to the left hand, allowing for easier and quicker grasping of same. Second, by positioning the charging handle further forward on the firearm, the charging handle is closer to the operator's left hand when it is supporting the barrel, allowing for a smoother transition of the left hand from barrel to charging handle, reducing barrel movement and loss of sight picture.

Another aspect of the present invention is to form into the left side of a standard gas tube a lateral aperture running along the longitudinal axis of the gas tube. The forward edge of the aperture is located rearward of the forward portion of the operating rod, such that the forward portion of the operating rod remains in a closed portion of the gas tube when the operating rod is in the forward position. The aperture allows access into the gas tube and access to the shaft of the operating rod. As such, when the bolt assembly is drawn rearward, the breach may be visually inspected through the lateral aperture to determine whether there is a round in the firing chamber. In addition, when the bolt assembly is drawn rearward the forward portion of the gas tube, the bore, and the chamber become accessible, allowing for cleaning of those portions of the firearm without need for further disassembly. Access to the inside of the gas tube through the aperture also acts as a means for faster cooling of the firearm, as now outside air can circulate inside the gas tube. This improves operation of the firearm, which tends to build up heat from the friction of the bullets moving along the barrel and the heat from the discharge gases after a substantial amount of ammunition is fired. It also allows for more efficient venting of the discharge gases after they have accomplished the task of moving the operating rod rearward. As the forward portion of the operating rod moves rearward past the front edge of the lateral aperture, the gases escape through the lateral aperture. This eliminates the need for a specially configured discharge configuration to vent the gases from the firearm.

Another aspect of the present invention is to introduce a semi-cylindrical sleeve onto the shaft of the operating rod. The sleeve provides an attachment for the charging handle, which extends through the lateral aperture of the gas tube. The rear portion of the sleeve impinges against the rear portion of the operating rod, such that when the sleeve is moved rearward, the operating rod, and the bolt assembly in connection therewith, are moved rearward with it. The combination of the lateral aperture formed into the left side of the gas tube, the sleeve fitted over the shaft of the operating rod, and the charging handle attached to the sleeve and extending from the left side of the firearm represent the basic configuration of the improved charging mechanism. This basic configuration may be easily retrofitted to existing firearms by simply substituting the modified gas tube for a standard gas tube and adding the sleeve and charging handle. The present invention contemplates such a conversion kit for retrofitting firearms, comprising the modified gas tube, the sleeve, and the charging handle.

In addition to the basic aspects of the present invention described above, another aspect of the present invention is to form a notch into the lateral aperture proximate to the rear edge of the aperture, with the notch configured to receive and hold the shaft of the charging handle. When the charging handle is moved rearward, as it becomes aligned with the notch the charging handle may be rotated upward such that its shaft fits into the notch. The notch then holds the charging handle in place, under tension by the recoil spring mechanism. This results in effectively holding the operating rod and the bolt assembly in place in the open breach position. The charging handle is able to rotate upwards due to the semi-cylindrical configuration of the sleeve, which is free to rotate about the shaft of the operating rod. So designed, the notch acts as a bolt lock. The bolt lock serves as an additional safety mechanism, as the firearm cannot fire a round when the bolt is locked in the open breach position. It also improves safety by allowing a visual inspection of the breach to see whether there is a round chambered therein (which could occur even if the ammunition magazine is empty or removed from the firearm). By locking the bolt in the open breach position, the forward portion of the gas tube, the bore, and the chamber can be easily cleaned through the lateral aperture, as described above. The bolt lock is released by rotating the charging handle shaft downward and out of the notch, so that it rides within the lateral aperture. Releasing the charging handle from the notch causes the recoil spring mechanism to force the bolt assembly, the operating rod, and the charging handle forward, resulting in the breach closing. The bolt lock can be easily released with just the thumb of the left hand, thereby allowing the firearm to be charged without removing the left hand from the barrel, minimizing barrel movement and loss of sight picture.

Another aspect of the present invention is to allow the charging handle to fold forward, out of the way when not in use. Another aspect of the present invention contemplates the removal of the standard right side charging handle, thereby freeing the bolt assembly to move rearward even when the safety lever is engaged. Thus, the firearm can have its safety lever engaged with the trigger locked while the operator chambers a round. No longer is it required for the safety to be disengaged in order to chamber a round. When the operator is ready to fire, the safety can be disengaged. These aspects further improve the safety profile of the firearm.

The improved charging mechanism allows a right handed operator to charge the firearm more easily. He or she no longer has to reach over or under to charge the rifle. The charging handle is now in a convenient location, proximate to the position where the operator must place the left hand while firing. This allows not only faster reloading then the existing configuration, but safer reloading. The operator no long has to worry about losing sight picture or unbalancing the firearm when charging the firearm. The charging handle is also in an improved location for carrying the firearm when it is slung across the chest by a sling strap. By being located further forward on the firearm, the charging handle is no longer in a spot where it may harm the operator if the firearm is forced into the chest, for example if the operator falls onto the firearm while carrying it by its sling.

The present invention also contemplates a method of retrofitting gas powered firearms to use the improved charging mechanism disclosed herein. The method includes the steps of obtaining a modified gas tube as disclosed above; obtaining a sleeve as disclosed above; obtaining a modified charging handle as disclosed above; disassembling the firearm, at least to the extent of removing the original gas tube and the operating rod; placing the sleeve over the shaft of the operating rod; reassembling the firearm, whereby the modified gas tube is substituted for the original gas tube and the operating rod with the sleeve placed over its shaft is inserted into the modified gas tube; and attaching the modified charging handle to the sleeve, with the optional step of removing the original charging handle from the right side of the firearm.

Other features and advantages of the invention are described below.

DETAILED DESCRIPTION OF THE INVENTION

Figure 1:
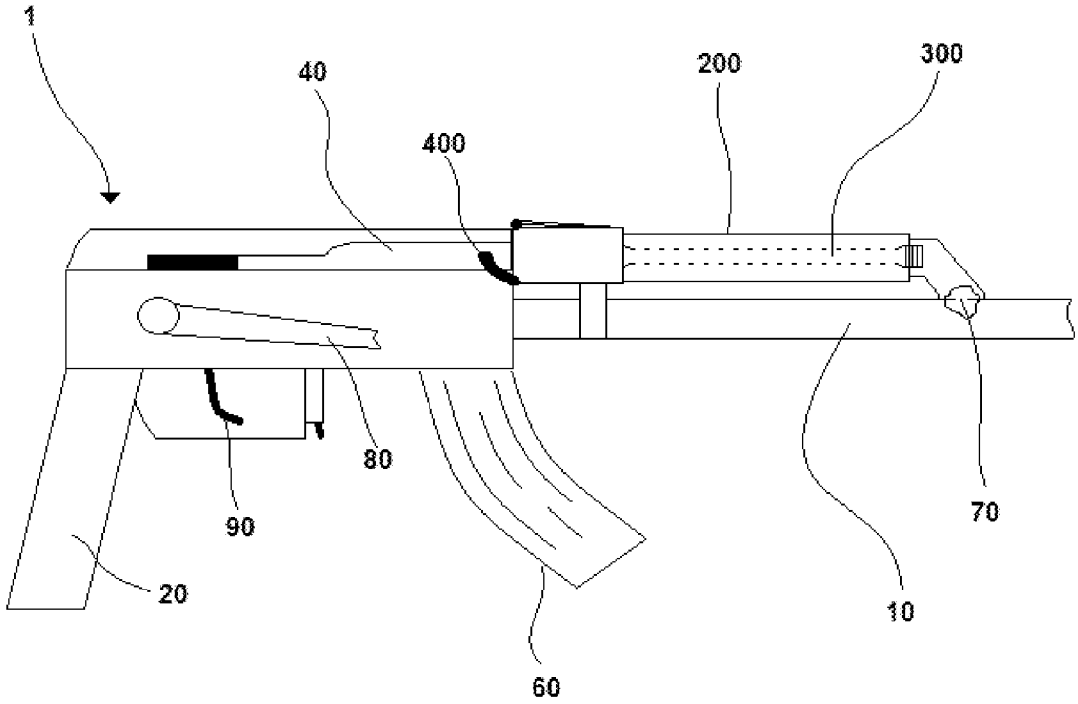
FIG. 1 is a side view of the right side of a prior art charging mechanism for a gas powered firearm. The operating rod is shown within the gas tube in ghost lines. A cutaway of the barrel exposes the gas port.
Figure 2:
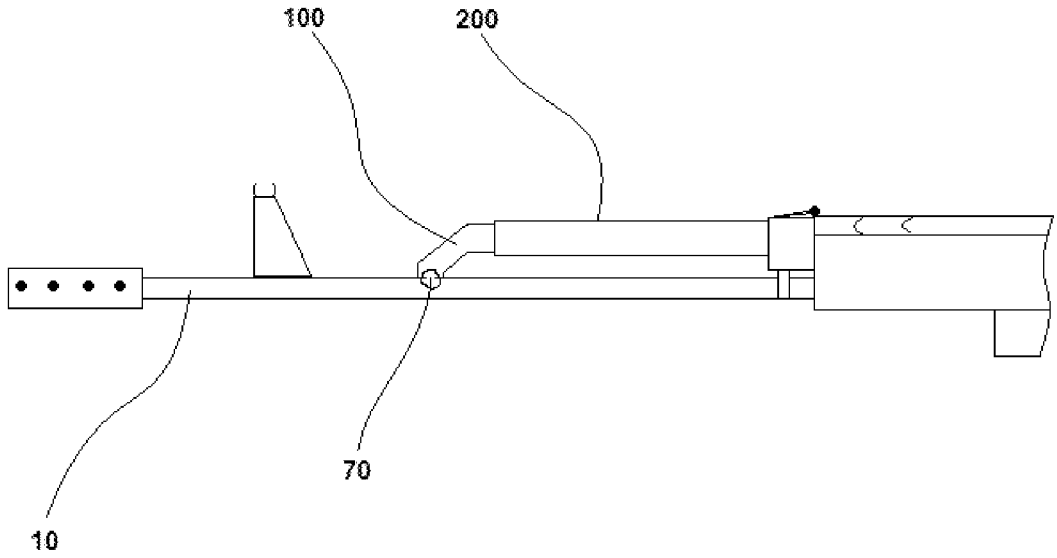
FIG. 2 is a partial side view of the left side of a prior art charging mechanism for a gas powered firearm. A cutaway of the barrel exposes the gas port.

An aspect of the present invention discloses an improved charging mechanism for a gas powered firearm 1. The present invention is intended to modify a firearm 1 having at least the following components: a barrel 10, a trigger 90, a firing chamber 30, a bolt assembly 40, a recoil spring mechanism 50, an operating rod 300, an ammunition magazine 60, a port 70 formed into the barrel 10, a gas block 100, a gas tube 200, and a charging handle 400. See FIGS. 1 and 2. The firearm 1 may also comprise a pistol grip 20 and a safety 80.

Figure 3:
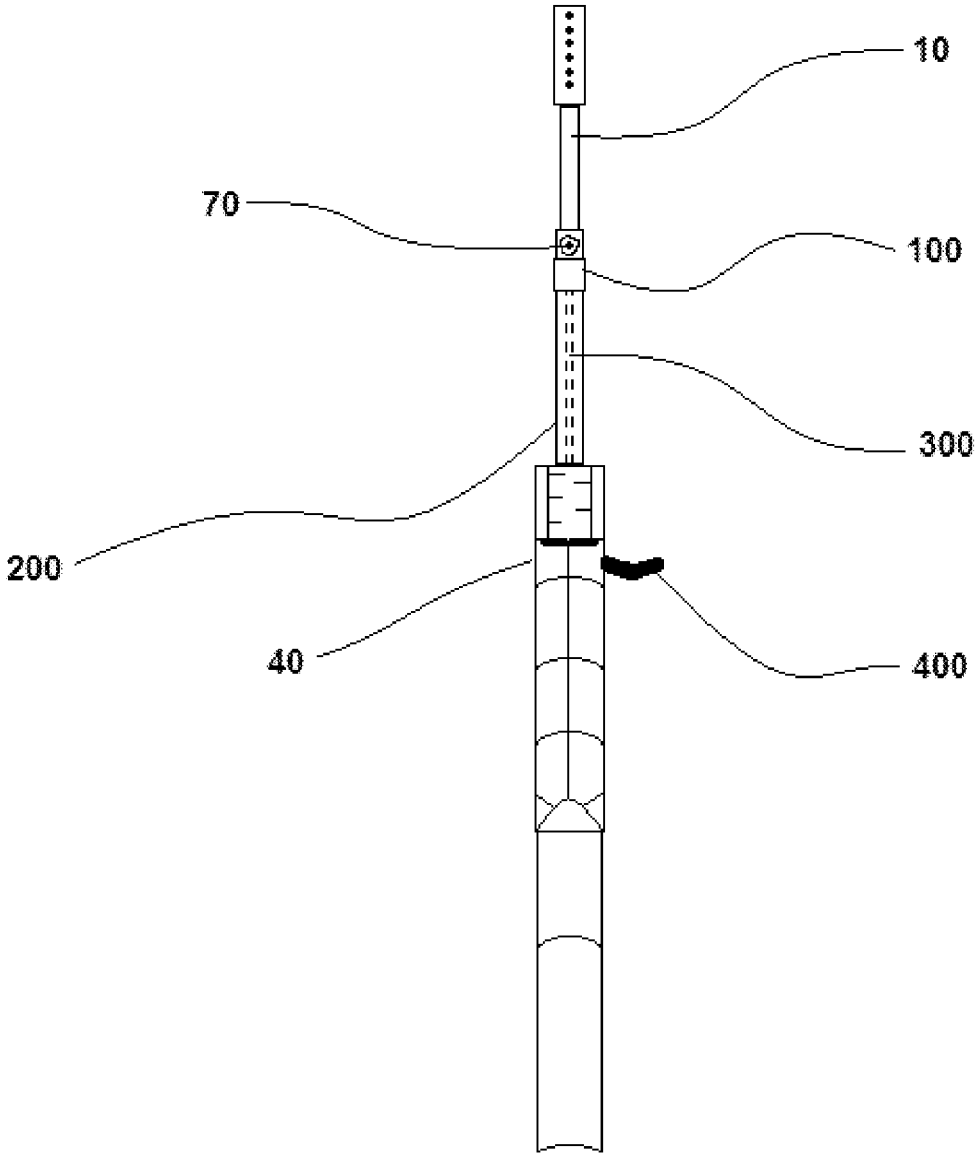
FIG. 3 is a top view of a prior art charging mechanism for a gas powered firearm. The operating rod is shown within the gas tube in ghost lines. A cutaway of the barrel exposes the gas port.
Figure 5:
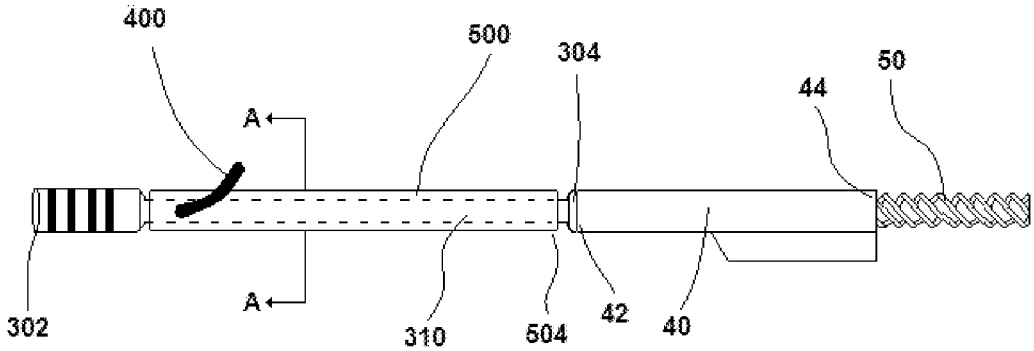
FIG. 5 is a side view of the operating rod, bolt assembly, and recoil spring mechanism of one aspect of the present invention, with the sleeve placed over the shaft of the operating rod, which is shown in ghost lines.

In operation, the bolt assembly 40 of the firearm 1 is suitably adapted to move forward and rearward, with its rearward movement causing a round of ammunition to be moved into the firing chamber 30 and its forward movement aligning the firing mechanism of the firearm 1 to permit firing of the round of ammunition. The movement of a round of ammunition into the firing chamber 30 and readying it for firing is known as charging the firearm 1. The operating rod 300 of the firearm 1 is located within the gas tube 200 and is suitably adapted to reciprocate forward and rearward within the gas tube 200, and is further in connection with the front portion 42 of the bolt assembly 40 and is suitably adapted to move the bolt assembly 40 in a rearward direction. See FIGS. 3 and 5. The operating rod 300 is rigid and substantially cylindrical, having a forward portion 302, a rear portion 304, and a shaft 310 interposed between the forward portion 302 and the rear portion 304, with the outside diameter of the shaft 310 less than the outside diameter of either the forward portion 302 or the rear portion 304 of the operating rod 300. The recoil spring mechanism 50 of the firearm 1 is in connection with the rear portion 44 of the bolt assembly 40 and is suitably adapted to bias the bolt assembly 40 in a forward direction upon being compressed when the bolt assembly 40 is moved in a rearward direction. See FIG. 5. The ammunition magazine 60 has a spring loading mechanism suitably adapted to move a round of ammunition upward and out of the magazine 60 and into the firing chamber 30 of the firearm 1 when the bolt assembly 40 has been moved to the rearward position.

The port 70 formed into the barrel 10 of the firearm 1 provides a communication between the barrel 10 and the gas tube 200 via the gas block 100, through which gases created by the firing of a round of ammunition may pass. See FIG. 2. These discharge gases passing out of the barrel 10 through the port 70 and gas block 100 into the gas tube 200 exert a pressure against the forward portion 302 of the operating rod 300 moving it rearward, thereby simultaneously moving the bolt assembly 40 rearward. The movement of the bolt assembly 40 rearward by the operating rod 300 as a result of pressure from the discharge gases, followed by the forward movement of the bolt assembly 40 by the recoil spring mechanism 50, constitutes an automatic charging cycle of the firearm 1. Alternatively, the charging handle 400 may be used by the operator to manually move the bolt assembly 40 rearward, constituting a manual charging cycle. A manual charging cycle is necessary to prepare the firearm 1 for firing a round of ammunition upon reloading. Variations on the specifics of the foregoing basic firearm components may be found, but the described functionality should be present. Examples of firearms having these basic components are the Kalashnikov (AK-47) rifle, the Kalashnikov (AK-74) rifle, the Kalashnikov (AK-101) rifle, the Kalashnikov (AK-103) rifle, the Samozaryadniy Karabin sistemi Simonova (SKS) rifle, and the Fusil Automatique Leger-Light Automatic Rifle (FN-FAL) rifle. The present invention may be used to retrofit other similarly configured gas powered firearms.

Figure 4:
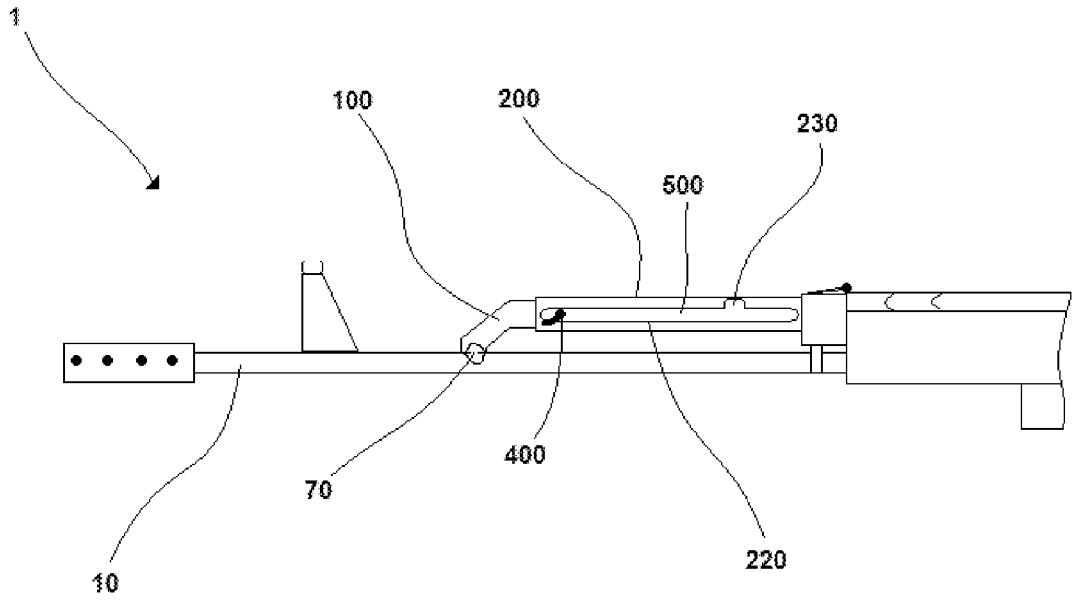
FIG. 4 is a partial side view of the left side of one aspect of the present invention. A cutaway of the barrel exposes the gas port.

The improved charging mechanism of the present invention comprises a modified gas tube 200, a sleeve 500, and a modified charging handle 400. See FIG. 4. The gas tube 200 is in communication with the gas block 100 such that gases created from the firing of a round of ammunition may be discharged from the barrel 10 of the firearm 1 through the port 70 and through the gas block 100 into the gas tube 200. The gas tube 200 should have a substantially cylindrically shaped interior 210 with a substantially constant inside diameter. The gas tube 200 of the present invention is suitably adapted to accommodate within its interior 210 the operating rod 300, which reciprocates forward and rearward within the gas tube 200. The inside diameter of the gas tube 200 should be substantially the same as, but not less than, the outside diameter of the forward portion 302 of the operating rod 300. A snug fit between the forward portion 302 of the operating rod 300 and the gas tube 200 minimizes the potential for discharge gases entering the gas tube 200 from the gas block 100 to leak around the forward portion 302 of the operating rod 300, thereby maximizing the force of the discharge gases against the forward portion 302 of the operating rod 300. The inside surface of the gas tube 200 and the outside surface of the forward portion 302 of the operating rod 300 may be polished or otherwise treated, such as with a lubricant, to minimize friction between the two surfaces.

The gas tube 200 further has a lateral aperture 220 formed into its left side, passing completely through the gas tube 200 into its interior 210. See FIG. 4. The lateral aperture 220 runs parallel to the longitudinal axis of the gas tube 200, and has substantially parallel top and bottom edges 226,228. The lateral aperture 220 provides access into the gas tube 200 of the present invention. This access allows cleaning of the forward portions of the gas tube 200 as well as providing visual access into the firing chamber 30 without disassembly of the firearm 1. In the preferred embodiment of the present invention, the front edge 222 of the lateral aperture 220 is located rearward of the location of the forward portion 302 of the operating rod 300 when the operating rod 300 is in a forward position within the gas tube 200. That is, the lateral aperture 220 is located behind the forward portion 302 of the operating rod 300 when it is in the forward position. This prevents discharge gases from escaping from the gas tube 200 through the lateral aperture 220 when the operating rod 300 is in the forward position. As the gases exert a pressure on the forward portion 302 on the operating rod 300, moving it rearward, the forward portion 302 of the operating rod 300 moves alongside the lateral aperture 220 exposing the interior 210 of the gas tube 200, thereby allowing the gases to vent from the gas tube 200 through the lateral aperture 220.

Figure 6:
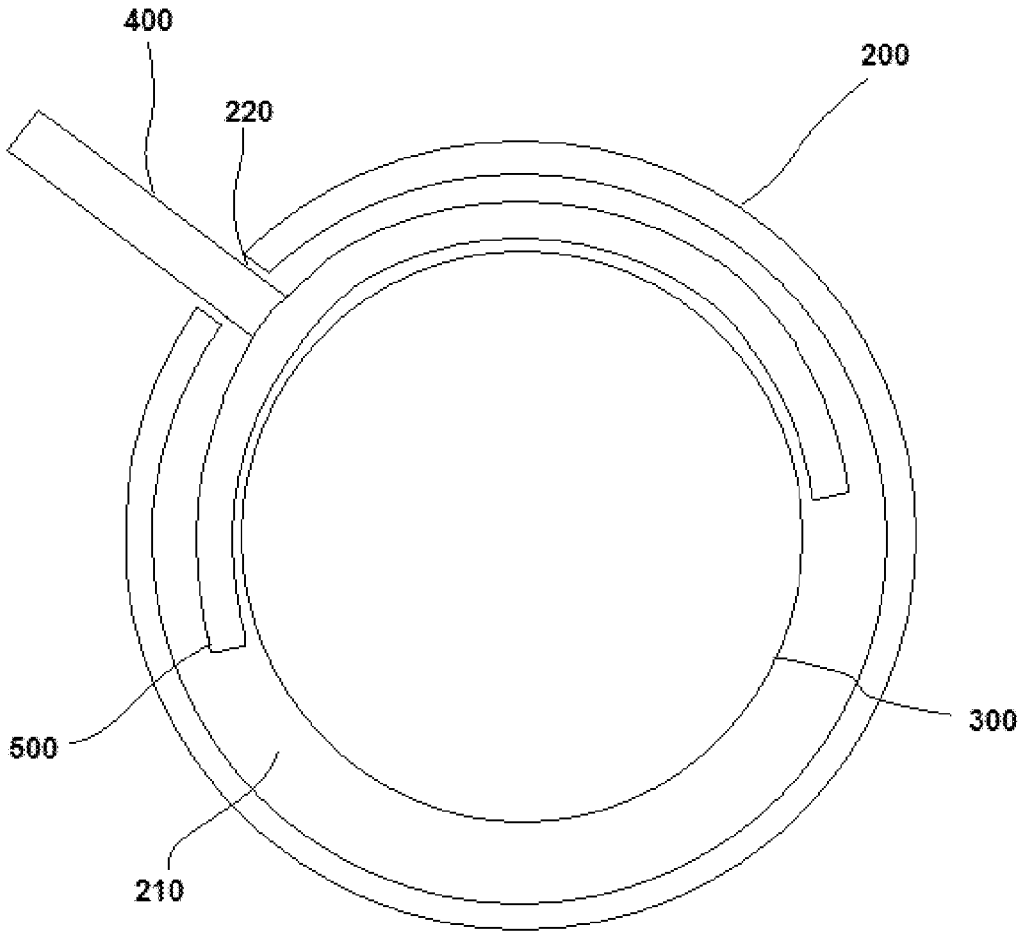
FIG. 6 is a rear cutaway view of the gas tube, sleeve, and operating rod shown in FIG. 5 taken on the line A-A.

In one embodiment the lateral aperture 220 of the gas tube 200 may be centered on the left side of the gas tube 200 substantially midway between the top and the bottom of the gas tube 200 (i.e., within a horizontal plane passing through the center of the gas tube 200). In another embodiment the lateral aperture 220 may be centered somewhat higher than the horizontal to the gas tube 200. In the preferred embodiment the lateral aperture 220 is centered not more than forty-five degrees (45°) above the horizontal. See FIG. 6.

Figure 7:
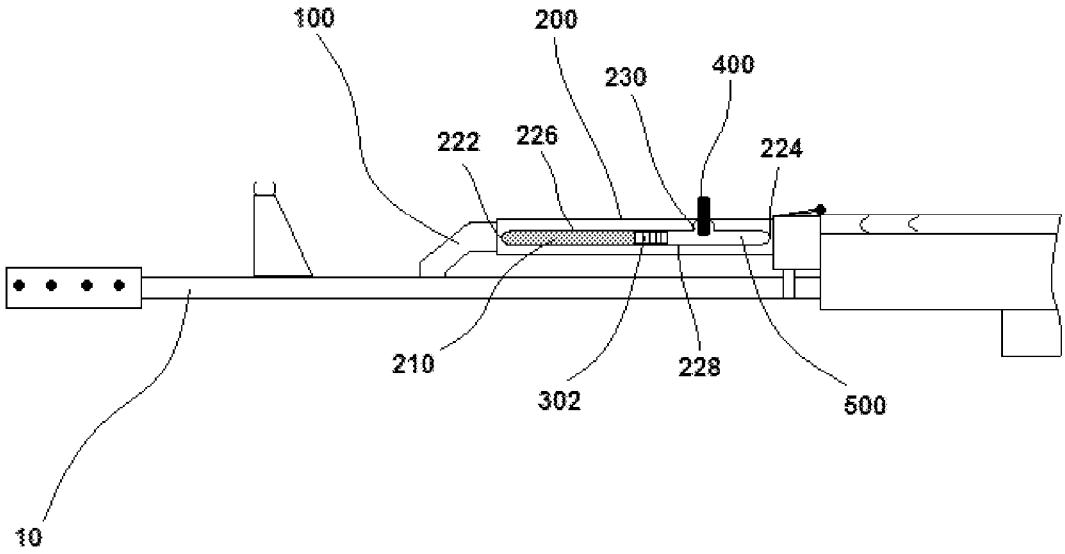
FIG. 7 is a partial side view of the left side of one aspect of the present invention with the charging handle drawn back and rotated into the notch, depicting the operating rod in a rearward position with the interior of the gas tube exposed.
Figure 8:
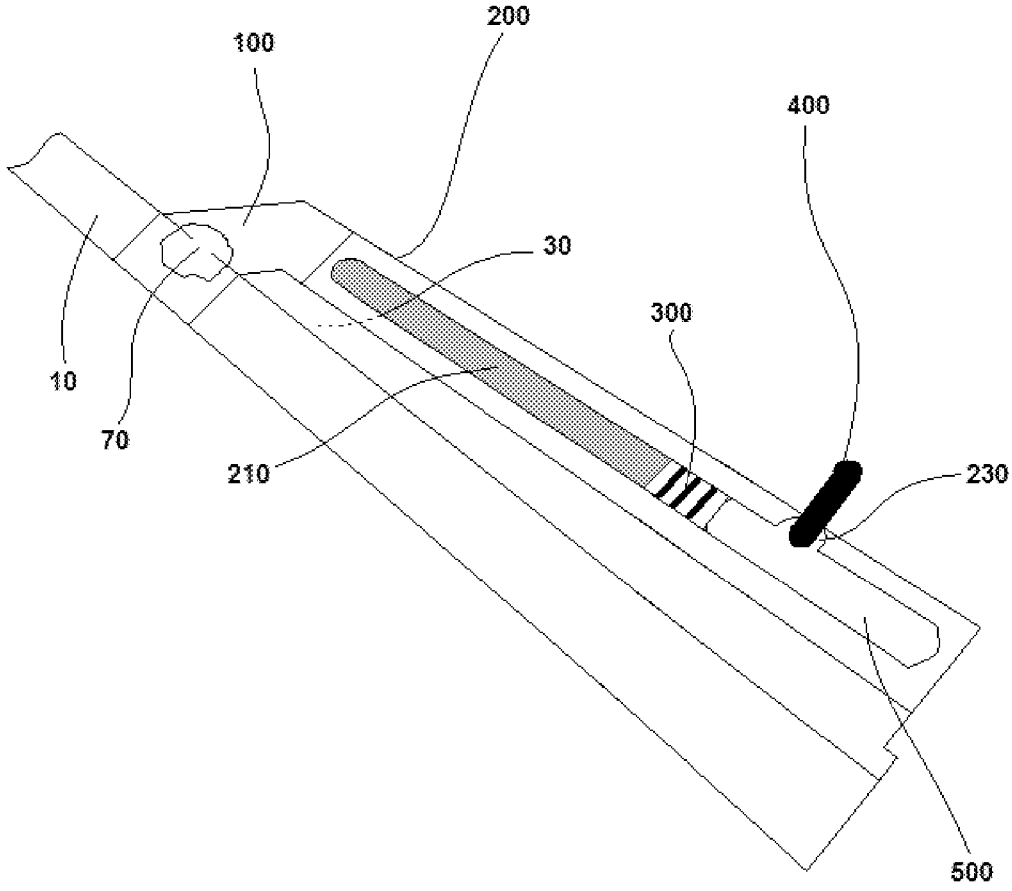
FIG. 8 is a perspective partial side view of the left side of one aspect of the present invention with the charging handle drawn back and rotated into the notch, depicting the interior of the gas tube exposed and indicating the location of the firing chamber. A cutaway of the barrel exposes the gas port.

The lateral aperture 220 of the gas tube 200 may further comprise a notch 230, with the notch 230 formed into the lateral aperture 220 along its top edge 226, proximate to its rear edge 224, thereby causing the lateral aperture 220 to have an inverted "T" configuration. See FIG. 4. The notch 230 has a width suitably adapted to receive and hold the modified charging handle 400 of the present invention. See FIGS. 4, 7, and 8.

Figure 11:
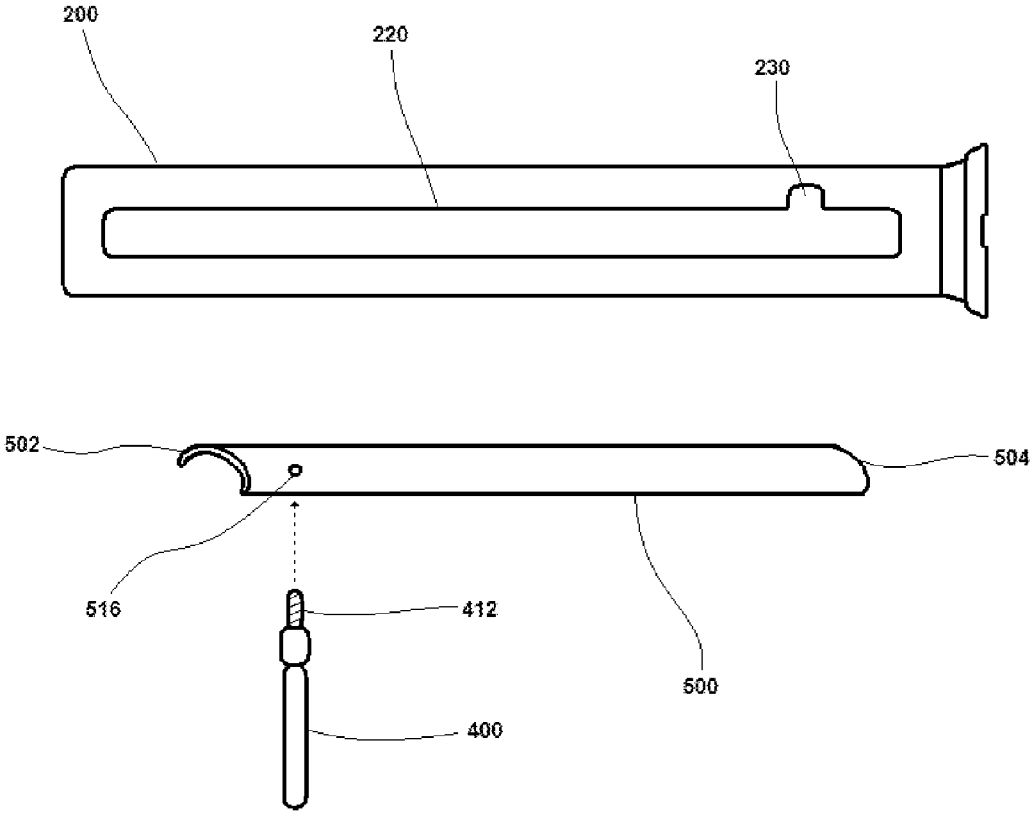
FIG. 11 is a side view of one aspect of the present invention depicting the modified gas tube, the sleeve, and one embodiment of the modified charging handle.

The sleeve 500 of the present invention has a substantially semi-cylindrical configuration, allowing the sleeve 500 to be placed onto the shaft 310 of the operating rod 300 within the gas tube 200. See FIGS. 6 and 11. As such, the sleeve 500 has an outside diameter substantially the same as but not greater than the inside diameter of the gas tube 200. The inside surface of the gas tube 200 and the outside surface of the sleeve 500 may be polished or otherwise treated, such as with a lubricant, to minimize friction between the two surfaces. The inside diameter of the sleeve 500 is substantially the same as but not less than the outside diameter of the shaft 310 of the operating rod 300 and the length of the sleeve 500 is substantially the same as but not longer than the length of the shaft 310 of the operating rod 300, thereby allowing the sleeve 500 to fit onto the shaft 310 of the operating rod 300. See FIG. 5.

In alternate embodiments the arc of the outer surface of the sleeve 500 may be significantly less than one hundred eighty degrees (180°), though preferably more than ninety degrees (90°). The dimensions of the sleeve 500 are such that the operating rod 300, with the sleeve 500 placed onto its shaft 310, will continue to fit into the gas tube 200 and reciprocate forward and rearward within the gas tube 200. The sleeve 500 may rotate about the shaft 310 of the operating rod 300 when it is placed thereon. Because the rear portion 304 of the operating rod 300 has an outside diameter greater than the outside diameter of the shaft 310 of the operating rod 300, the rear portion 504 of the sleeve 500 will impinge against the front of the rear portion 304 of the operating rod 300 when the sleeve 500 is placed onto the shaft 310 of the operating rod 300 and moved rearward. See FIG. 5. Movement of the sleeve 500 rearward therefore exerts pressure on the rear portion 304 of the operating rod 300 and moves the operating rod 300 rearward.

The charging handle 400 of the present invention is suitably adapted to be attached to the sleeve 500, such that the charging handle 400 extends from the sleeve 500 through the lateral aperture 220 of the gas tube 200 and extends outward from the left side of the firearm 1 when the sleeve 500 is placed onto the shaft 310 of the operating rod 300 and the operating rod 300 is placed within the gas tube 200. In the preferred embodiment the charging handle 400 is attached to the sleeve 500 proximate to the forward end 502 of the sleeve 500. See FIG. 5. In the most preferred embodiment the charging handle 400 is removably attached to the sleeve 500. The operator of the firearm 1 may move the charging handle 400 rearward, which simultaneously moves the sleeve 500 rearward, effecting rearward pressure upon the rear portion 304 of the operating rod 300 and thereby moving the operating rod 300 and the bolt assembly 40 rearward, thus beginning the manual charging cycle. Releasing the charging handle 400 results in the recoil spring mechanism 50 moving the bolt assembly 40 forward while simultaneously moving the operating rod 300, the sleeve 500, and the charging handle 400 forward, completing the manual charging cycle.

In embodiments of the present invention utilizing a notch 230 formed into the lateral aperture 220, the notch 230 should be located rearward of the position of the charging handle 400 when the bolt assembly 40 is in its forward position. See FIG. 4. In such configurations, the charging handle 400 may be moved into the notch 230 by the operator of the firearm 1 drawing the charging handle 400 rearward until the charging handle 400 is aligned with the notch 230 and then moving the charging handle 400 upward into the notch 230. See FIGS. 7 and 8. The charging handle 400 is capable of being moved into the notch 230 because the sleeve 500 to which the charging handle 400 is attached is capable of rotating about the shaft 310 of the operating rod 300. The recoil spring mechanism 50 exerts a force against the bolt assembly 40, which translates to the operating rod 300, the sleeve 500, and the charging handle 400, holding the charging handle 400 within the notch 230. In this configuration the notch 230 acts as a bolt lock. The bolt assembly 40 is held in an open position and cannot be moved until the charging handle 400 is moved out of the notch 230. The bolt lock therefore acts as an alternative safety mechanism. It also acts as a means for maintaining access to the firing chamber 30 through the lateral aperture 220 for cleaning purposes.

Figure 12:
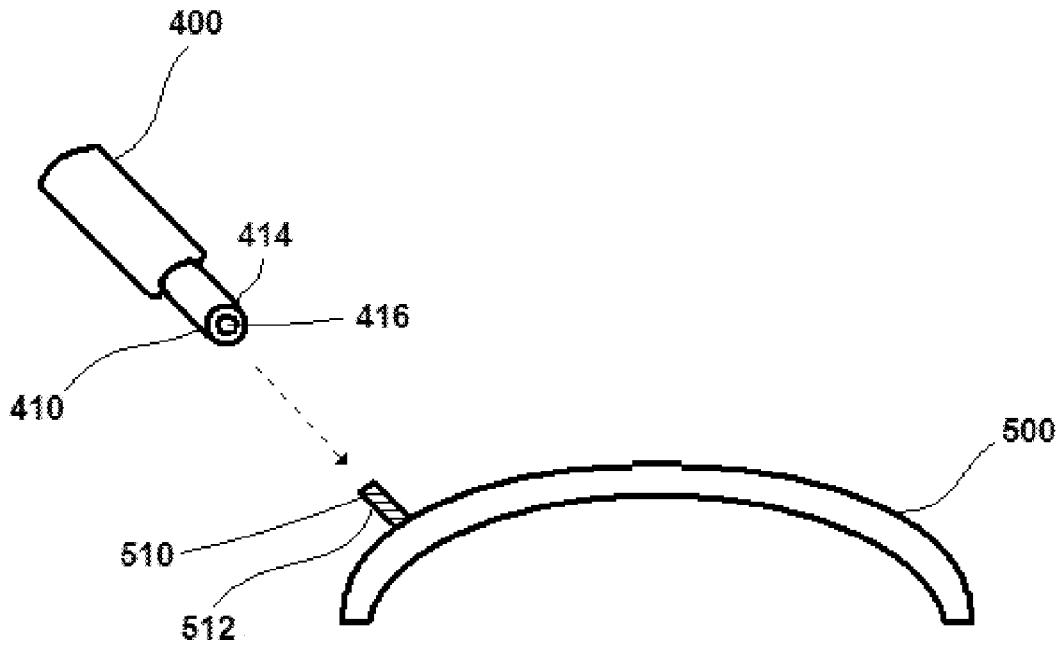
FIG. 12 is a rear cutaway view of one aspect of the present invention depicting the sleeve and another embodiment of the modified charging handle.

In the preferred embodiment of the present invention the charging handle 400 comprises a shaft 410, whereby the shaft 410 of the charging handle 400 is suitably adapted to connect the charging handle 400 to the sleeve 500. In one embodiment the shaft 410 of the charging handle 400 comprises threads 412 formed thereon and the sleeve 500 comprises a threaded aperture 516 formed therein, with the threaded aperture 516 of the sleeve 500 suitably adapted to accommodate the threads 412 formed onto the shaft 410 of the charging handle 400. See FIG. 11. In this embodiment, the charging handle 400 is connected to the sleeve 500 by screwing the threaded shaft 410 of the charging handle 400 into the threaded aperture 516 of the sleeve 500. In another embodiment the sleeve 500 comprises a pin 510 extending laterally therefrom, with the pin 510 having threads 512 formed thereupon. The shaft 410 of the charging handle 400 comprises an end 414 and a threaded aperture 416 formed into the end 414 of the shaft 410 of the charging handle 400, with the threaded aperture 416 suitably adapted to accommodate the threads 512 formed onto the shaft of said pin 510. See FIG. 12. The charging handle 400 is connected to the sleeve 500 by screwing the threaded aperture 416 in the end 414 of the charging handle 400 onto the threaded pin 510 of the sleeve 500. Other known configurations for removably attaching the shaft 410 of the charging handle 400 to the sleeve 500 are also contemplated by the present invention.

Figure 9:
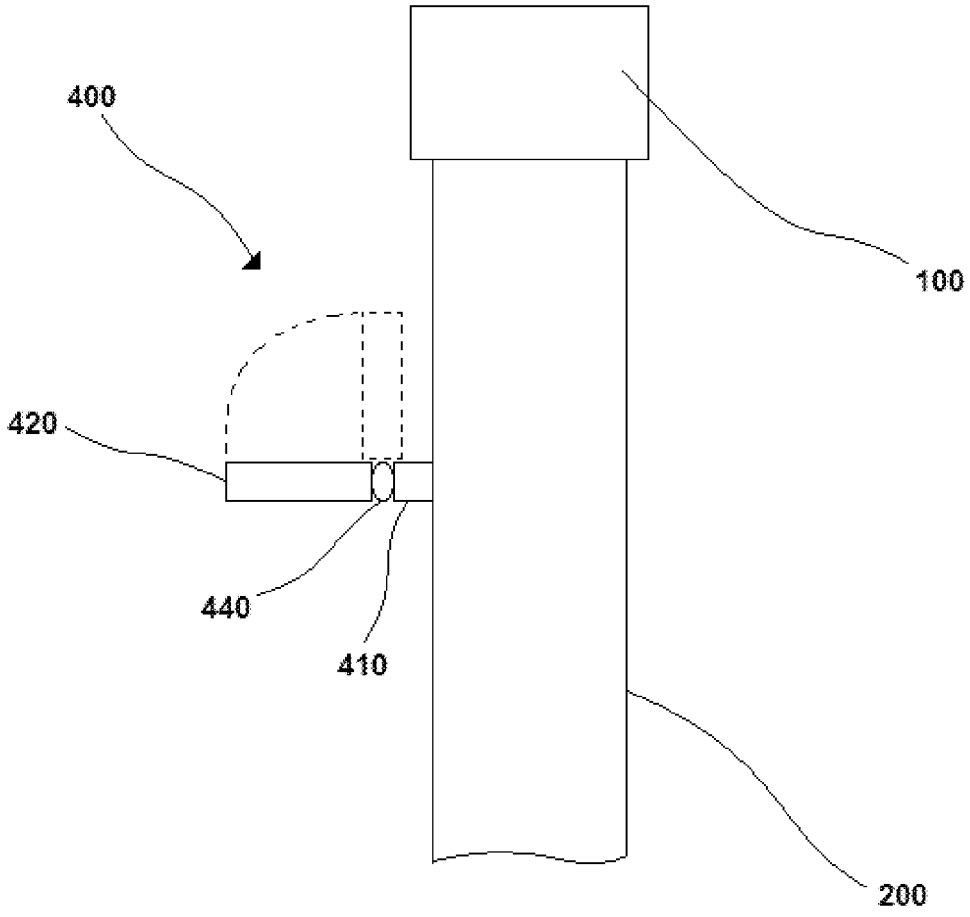
FIG. 9 is a partial top view of one aspect of the present invention depicting an alternative embodiment of the charging handle, with ghost lines showing the direction of hinged motion and the folded position of the gripping member of the charging handle.
Figure 10A:
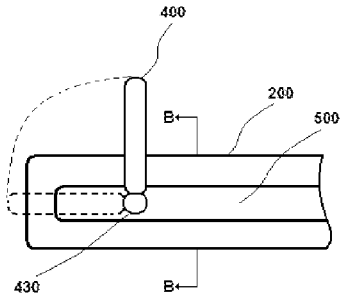
FIG. 10A is a partial side view of the left side of one aspect of the present invention depicting another alternative embodiment of the charging handle, with ghost lines showing the direction of pivoting motion and the forward position of the gripping member of the charging handle.
Figure 10B:
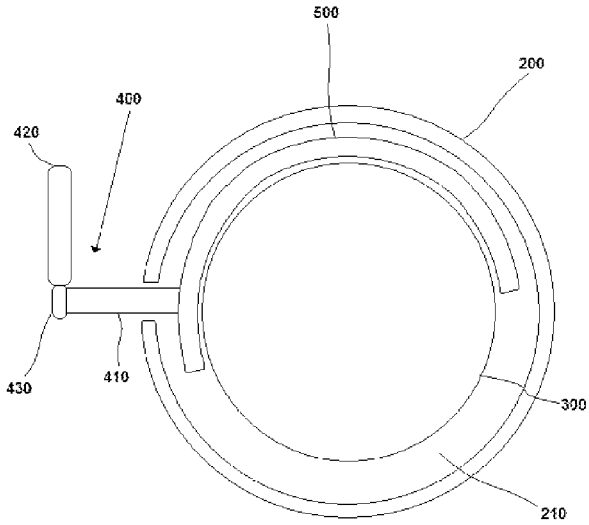
FIG. 10B is a rear cutaway view of the gas tube, sleeve, and operating rod of the embodiment shown in FIG. 10A taken on the line B-B.

In the embodiments of the present invention in which the charging handle 400 comprises a shaft 410 and the gas tube 200 comprises a notch 230, the width of the notch 230 is suitably adapted to receive and hold the shaft 410 of the charging handle 400. Positioning the shaft 410 of the charging handle 400 into the notch 230 in these embodiments serves as a bolt lock. In other embodiments of the present invention the charging handle 400 comprises a gripping member 420 and a pivot mechanism 430, with the gripping member 420 oriented substantially perpendicular to the shaft 410 of the charging handle 400. See FIGS. 10A and 10B. The pivot mechanism 430 connects the gripping member 420 to the shaft 410 of the charging handle 400, such that the pivot mechanism 430 permits the gripping member 420 of the charging handle 400 to be rotated forward toward the front of the firearm 1 in a substantially horizontal orientation and rotated rearward to extend substantially vertically. In yet other embodiments of the present invention the charging handle 400 comprises a gripping member 420 and a hinge mechanism 440, with the hinge mechanism 440 suitably adapted to permit the gripping member 420 of the charging handle 400 to be folded forward toward the firearm 1 and unfolded to extend substantially perpendicularly from the firearm 1. See FIG. 9. In yet other embodiments of the present invention the charging handle 400 is angled to provide a more comfortable grip for the operator's hand. Other configurations of the charging handle 400 are also contemplated.

The present invention also contemplates a method of retrofitting a gas powered firearm 1. The firearm 1 comprises a barrel 10, a firing chamber 30, a bolt assembly 40, a recoil spring mechanism 50 in connection with a rear portion 44 of the bolt assembly 40, a right side charging handle in connection with the bolt assembly 40, an operating rod 300 in connection with a front portion 42 of the bolt assembly 40, an ammunition magazine 60 having a spring loading mechanism, a port 70 formed into the barrel 10 providing a communication between the barrel 10 and a gas block 100, and a closed gas tube in connection with the gas block 100, all as described above.

The method of retrofitting the gas powered firearm 1 comprises the steps:

A. obtaining a modified gas tube 200 having the characteristics and functions described above, see FIG. 11;

B. obtaining a sleeve 500 having the characteristics and functions described above, see FIG. 11;

C. obtaining a modified charging handle 400 having the characteristics and functions described above, see FIG. 11;

D. disassembling the firearm 1, at least to the extent of removing the closed gas tube and the operating rod 300;

E. placing the sleeve 500 over the shaft 310 of the operating rod 300;

F. reassembling the firearm 1, whereby the modified gas tube 200 is substituted for the closed gas tube and the operating rod 300 with the sleeve 500 placed over its shaft 310 is inserted into the modified gas tube 200; and G. attaching the modified charging handle 400 to the sleeve 500.

Steps A-D of the method may be performed in any order, step E may be performed any time after steps B and D and before step F, step F may be performed any time after steps A, B, D, and E, and step G may be performed any time after steps B and C.

In an alternative method, the optional step H may be performed at any time relative to steps A-G, with step H involving removing the right side charging handle from the firearm 1.

What has been described and illustrated herein is a preferred embodiment of the invention along with some it its variations. The terms, descriptions and figures used herein are set forth by way of illustration only and are not meant as limitations. Those skilled in the art will recognize that many variations are possible within the spirit and scope of the invention as defined in the following claims in which all terms are meant in their broadest, reasonable sense unless otherwise indicated.

I claim:

1. An improved charging mechanism for a gas powered firearm, said firearm comprising a barrel, a firing chamber, a bolt assembly, a recoil spring mechanism in connection with a rear portion of the bolt assembly, an operating rod in connection with a front portion of the bolt assembly, an ammunition magazine having a spring loading mechanism, and a port formed into the barrel providing a communication between the barrel and a gas block, said improved charging mechanism comprising a gas tube, said gas tube being in communication with the gas block such that gases created from the firing of a round of ammunition may be discharged from the barrel through the port and through the gas block into said gas tube, said gas tube having a substantially cylindrically shaped interior with a substantially constant inside diameter, said gas tube suitably adapted to accommodate within its interior the operating rod, whereby the operating rod has a forward portion, a rear portion, and a shaft interposed between the forward portion and the rear portion, said shaft having a length, with the operating rod able to move forward and rearward within said gas tube, and said gas tube further having a lateral aperture formed into its left side, passing through said gas tube into its interior, the lateral aperture running parallel to a longitudinal axis of said gas tube, with the lateral aperture having a front edge, a rear edge, a top edge, and a bottom edge, with the top and bottom edges substantially parallel to each other;

a sleeve, said sleeve having a partial cylindrical configuration, with said sleeve being suitably adapted to be placed onto the shaft of the operating rod within the gas tube; and a charging handle, said charging handle suitably adapted to be removably attached to the sleeve, such that said charging handle extends from the sleeve through the lateral aperture of the gas tube and extends outward from the left side of the firearm;

whereby movement of the charging handle rearward simultaneously moves the sleeve rearward, effecting rearward pressure upon the rear portion of the operating rod and thereby moving the operating rod and the bolt assembly rearward, which in turn opens the firing chamber, ejects any cartridge casing from the firing chamber, compresses the recoil spring mechanism, and allows a round of ammunition to be moved from the ammunition magazine by the spring loading mechanism into the firing chamber, and cessation of the application of a rearward force on the charging handle results in the recoil spring mechanism moving the bolt assembly forward and simultaneously moving the operating rod, the sleeve, and the charging handle forward, resulting in the newly chambered round being ready to be fired.

2. The improved charging mechanism of claim 1 wherein the sleeve is substantially semi-cylindrical.

3. The improved charging mechanism of claim 1 wherein the gas tube further comprises a notch, said notch formed into the lateral aperture along the top edge of the lateral aperture and proximate to the rear edge of the lateral aperture, said notch passing through the gas tube into its interior, said notch having a width suitably adapted to receive and hold the charging handle.

4. The improved charging mechanism of claim 1 wherein the front edge of the lateral aperture of the gas tube is located rearward of the location of the forward portion of the operating rod when the operating rod is in a forward position within said gas tube.

5. The improved charging mechanism of claim 1 wherein the forward portion of the operating rod has an outside diameter substantially the same as but not greater than the inside diameter of the gas tube, the shaft of the operating rod has an outside diameter less than the inside diameter of the gas tube, and the rear portion of the operating rod has an outside diameter greater than the outside diameter of the shaft of the operating rod but not greater than the inside diameter of said gas tube; and the sleeve has an outside diameter substantially the same as but not greater than the inside diameter of the gas tube, an inside diameter substantially the same as but not less than the outside diameter of the shaft of the operating rod, and a length substantially the same as but not longer than the length of the shaft of the operating rod.

6. The improved charging mechanism of claim 1 wherein the charging handle comprises a shaft, whereby the shaft of the charging handle is suitably adapted to connect the charging handle to the sleeve.

7. The improved charging mechanism of claim 6 wherein the gas tube further comprises a notch, said notch formed into the lateral aperture along the top edge of the lateral aperture and proximate to the rear edge of the lateral aperture, said notch passing through the gas tube into its interior, said notch having a width suitably adapted to receive and hold the shaft of the charging handle.

8. The improved charging mechanism of claim 6 wherein the shaft of the charging handle comprises threads formed thereon and the sleeve comprises a threaded aperture formed therein, said threaded aperture suitably adapted to accommodate the threads formed onto the shaft of the charging handle, whereby the charging handle is connected to the sleeve by screwing the threaded shaft of the charging handle into the threaded aperture of the sleeve.

9. The improved charging mechanism of claim 6 wherein the sleeve comprises a pin extending laterally therefrom, said pin having threads formed thereupon, and the shaft of the charging handle comprises an end and a threaded aperture formed into the end of the shaft of the charging handle, said threaded aperture suitably adapted to accommodate the threads formed onto the shaft of said pin, whereby the charging handle is connected to the sleeve by screwing the threaded aperture in the end of the charging handle onto the threaded pin of the sleeve.

10. The improved charging mechanism of claim 6 wherein the charging handle further comprises a gripping member and a pivot mechanism, said gripping member oriented substantially perpendicular to the shaft of the charging handle, said pivot mechanism connecting said gripping member to the shaft of the charging handle, said pivot mechanism suitably adapted to permit the gripping member of the charging handle to be rotated forward toward the front of the firearm in a substantially horizontal orientation and rotated rearward to extend substantially vertically.

11. The improved charging mechanism of claim 6 wherein the charging handle further comprises a gripping member and a hinge mechanism, said hinge mechanism suitably adapted to permit the gripping member of the charging handle to be folded forward toward the firearm and unfolded to extend substantially perpendicularly from the firearm.

12. The improved charging mechanism of claim 7 wherein the shaft of the charging handle comprises threads formed thereon and the sleeve comprises a threaded aperture formed therein, said threaded aperture suitably adapted to accommodate the threads formed onto the shaft of the charging handle, whereby the charging handle is connected to the sleeve by screwing the threaded shaft of the charging handle into the threaded aperture of the sleeve.

13. The improved charging mechanism of claim 7 wherein the sleeve comprises a pin extending laterally therefrom, said pin having threads formed thereupon, and the shaft of the charging handle comprises an end and a threaded aperture formed into the end of the shaft of the charging handle, said threaded aperture suitably adapted to accommodate the threads formed onto the shaft of said pin, whereby the charging handle is connected to the sleeve by screwing the threaded aperture in the end of the charging handle onto the threaded pin of the sleeve.

14. The improved charging mechanism of claim 7 wherein the charging handle further comprises a gripping member and a pivot mechanism, said gripping member oriented substantially perpendicular to the shaft of the charging handle, said pivot mechanism connecting said gripping member to the shaft of the charging handle, said pivot mechanism suitably adapted to permit the gripping member of the charging handle to be rotated forward toward the front of the firearm in a substantially horizontal orientation and rotated rearward to extend substantially vertically.

15. The improved charging mechanism of claim 7 wherein the charging handle further comprises a gripping member and a hinge mechanism, said hinge mechanism suitably adapted to permit the gripping member of the charging handle to be folded forward toward the firearm and unfolded to extend from the firearm.

* * * * *